US006370912B1

(12) United States Patent
Sutton

(10) Patent No.: US 6,370,912 B1
(45) Date of Patent: Apr. 16, 2002

(54) VAGINAL JEWELRY AND EXERCISE DEVICE

(76) Inventor: James G. S. Sutton, 804 S. Federal Hwy., Hallandale, FL (US) 33009

( * ) Notice: Subject to any disclaimer, the term of this patent is extended or adjusted under 35 U.S.C. 154(b) by 0 days.

(21) Appl. No.: 09/036,611

(22) Filed: Mar. 7, 1998

Related U.S. Application Data

(60) Provisional application No. 60/056,755, filed on Aug. 20, 1997.

(51) Int. Cl.[7] ..... A44C 7/00

(52) U.S. Cl. ..... 63/12; 63/13; 63/21; 63/23; 63/33; 482/92; 482/93; 482/105; 482/148

(58) Field of Search ..... 63/1.11, 1.13, 63/1.14, 12, 13, 21, 23, 33; 482/92, 93, 105, 148; 604/385.1, 358; D24/141, 215; 424/432

(56) References Cited

U.S. PATENT DOCUMENTS

| | | | | | |
|---|---|---|---|---|---|
| 718,708 | A | * | 1/1903 | Geiger et al. | 63/13 |
| 1,941,717 | A | * | 1/1934 | Rabell | 604/377 |
| D105,901 | S | * | 8/1937 | Schwartz | D3/211 |
| D117,924 | S | * | 12/1939 | Joyce | D11/56 |
| 3,037,506 | A | * | 6/1962 | Penksa | 604/385.1 |
| 3,101,714 | A | * | 8/1963 | Penksa | 604/385.1 |
| 3,446,034 | A | * | 5/1969 | Driscoll | 63/13 |
| 4,111,196 | A | * | 9/1978 | Emmett | 128/130 |
| 4,241,912 | A | * | 12/1980 | Mercer et al. | 272/125 |
| 4,259,850 | A | * | 4/1981 | Lalieu | 63/13 |
| 4,296,459 | A | * | 10/1981 | DeLuca | 362/104 |
| 4,589,404 | A | * | 5/1986 | Barath et al. | 128/6 |
| 4,787,895 | A | * | 11/1988 | Stokes et al. | 604/358 |
| 4,895,363 | A | * | 1/1990 | Plevnik et al. | 482/93 X |
| 5,213,557 | A | * | 5/1993 | Firth | 482/93 X |
| D347,801 | S | * | 6/1994 | Church | D11/40 |
| 5,417,224 | A | * | 5/1995 | Petrus et al. | 128/833 |
| 5,497,307 | A | * | 3/1996 | Bae et al. | 63/1.13 X |
| 5,649,758 | A | * | 7/1997 | Dion | 362/103 |
| 5,675,989 | A | * | 10/1997 | Abraskin | 63/41 |

FOREIGN PATENT DOCUMENTS

| | | | | |
|---|---|---|---|---|
| GB | 2077091 | * | 12/1981 | 63/13 |

* cited by examiner

*Primary Examiner*—B. Dayoan
*Assistant Examiner*—Andrea Chop
(74) *Attorney, Agent, or Firm*—Lori Weisenbach

(57) ABSTRACT

A piece of jewelry designed to adorn and decorate the pelvic region of a human female. The piece of jewelry comprises an anchor member which is worn within the vagina, a decorative charm and a connecting chain long enough to permit the decorative charm to lie outside the labia comfortably. The piece of jewelry is also an ornamental device which provides the wearer a means to exercise her pubococcygeus muscle.

16 Claims, 4 Drawing Sheets

VAGINAL JEWELRY AND EXERCISE DEVICE

CROSS REFERENCE OF OTHER APPLICATIONS

This application claims the filing date of provisional application No. 60/056,755 filed on Aug. 20, 1997.

STATEMENT REGARDING FEDERALLY SPONSORED RESEARCH OF DEVELOPMENT

Not applicable.

BACKGROUND OF THE INVENTION

1. Field of the Invention

The invention relates to a an ornamental device, more specifically to a device designed to adorn and enhance the beauty of the pelvic region of a human female as a piece of jewelry. The ornamental device is also provides a means to exercise the pubococcygeus muscle of the human female pelvic structure, thereby strengthening said muscle.

2. Description of Prior Art

Jewelry as an expression of the art of personal ornamentation begins its history in the most ancient of civilizations. Archeologists date the wearing of decorative objects around the neck from the stone age. During the period of the Renaissance jewelry chosen to adorn the body had both political and spiritual significance. Many types of jewelry are known to adorn various female body parts, including the breasts and nipples.

The invented piece of jewelry and ornamental device provides for the decoration and adornment of the female pelvic region. Although jewelry is known for many female body parts, including the limbs, ears and breasts, the invented piece of jewelry and ornamental device offers a new choice in body jewelry and personal expression for the wearer.

The invention also provides a means for exercising the pubococcygeus muscle of the human female pelvic structure. The anchor of the ornamental device is inserted and held within the vaginal walls of the human female. The action of contracting and controlling the vaginal muscles to control the position of the ornament within the vagina can be done in a rhythmic, repetitious manner to exercise the pubococcygeus muscle, hereinafter called the PC muscle.

As is known in the medical arts, the perineometer, invented by Dr. Kegel, is a device designed to observe the strength of the contractions of a patient's pubococcygeus muscle. The perineometer is a hollow rubber cone supported on a form so that it can be inserted into the region of the vagina which is surrounded by the PC muscle. The PC muscle is exercised in the perineometer by contracting the muscles and compressing or squeezing the device.

Other examples of the known art of vaginal exercise devices are found in U.S. Pat. No. 4,048,985, wherein a the device consists in essence of a flexible tube with a pressure gauge, U.S. Pat. No. 4,574,791 which teaches a pear shaped flexible bulb to exercise the PC muscle, U.S. Pat. No. 4,050,449 which teaches a balloon with cylindrical walls and pressure gauge to indicate the force of the muscle contraction, and U.S. Pat. No. 4,241,912 which uses a round shaft with flange to limit insertion into the vagina. In these devices the exercise of the PC muscle occurs when the inserted portion of the device is compressed by muscle action of the PC muscle during the exercise.

Limitations and disadvantages of prior the art include the unattractiveness of the known devices and the clinical nature of the devices. The exercise of the muscles is a chore using the devices of the prior art, requiring the woman make special arrangements and scheduling to complete the exercises. The invention overcomes these limitations by providing an attractive, comfortable, low cost, exercise device which may also be worn as a body ornament or jewelry.

The existing exercise devices are complex, and are designed to be used only for the purpose of exercising the vaginal muscles. The invention described herein, in contrast, is designed to be worn for extended periods of time, as a piece of jewelry and body ornament as well as an exercise device. Thus a woman may wear the device as jewelry and have the option to use the device to exercise her PC muscle at any time.

The presence of the anchor member of the device within the vagina exerts gentle continuous pressure on the PC muscle, providing the woman continuous stimulation to exercise by tightening the muscles of the vaginal walls around the device. The PC muscle is exercised as the position of the anchor member within the vagina is controlled by the action of the PC muscle on the anchor member as the woman contracts and releases the PC muscle.

Further, the attractive appearance of the ornamental device serves to enhance the exercise experience for the woman. Rather than a clinical device, the invention offers the woman an attractive ornamental device, which may be shared with or received from an intimate partner, increasing the pleasure of the experience and increasing the likelihood of usage by the woman.

SUMMARY OF THE INVENTION

A new piece of jewelry and ornamental device is provided which is designed to adorn and decorate the pelvic region of the human female. The invention may be worn as an erotic piece of jewelry and also provides the wearer a convenient means to exercise her vaginal muscles. The piece of jewelry and ornamental device comprises an anchor member, a decoration and a means to connect said anchor member to the decoration. The anchor member of the invention of the preferred embodiment is a rigid, extruded acrylic sphere. The anchor member of the piece of jewelry and ornamental device is designed to be inserted into the vagina and worn for extended periods of time. The anchor member is easy to clean and maintain, requiring no special cleaning treatment or storage conditions.

The piece of jewelry is designed to be visually pleasing to both the woman and her sexual partner and to provide the woman pleasurable sensual feelings and enjoyment. The decoration of the jewelry may simply be an attractive charm or a precious gem stone, or special shape with special significance to the woman and her partner.

The anchor member of the invention in positioned within the vaginal walls by the exertion of the wearer to tighten and contract her PC muscle. The PC muscle of the wearer controls the position of the device within the vaginal cavity. The muscle action required to position the anchor has the effect of exercising the PC muscles. The sensation of the anchor within the body with the movement of the anchor provides the user a means of exercising the PC muscles.

The invention improves over the prior art by permitting the user to exercise the muscles at any time. Further the attractive appearance of the invention is intended to overcome any psychological objections to the exercise program. The muscles can be exercised at any time, without special arrangement or exertion. Another advantage of the invention is that the attractive appearance offers an opportunity for the user's sex partner to participate in the process and encourage the user to do the exercises.

To increase the strength of the PC muscle, it is necessary that the woman exercise the muscle, by contracting and relaxing the muscle on a regular basis. Once the muscle has been toned and strengthened, muscle tone is maintained by regular exercise of the muscle. The invention is designed to be pleasing to the eye, and add to the users sensual and sexual pleasure, making the exercise process a pleasure, rather than a chore.

The use of the invention as a piece of sensual body jewelry increases the likelihood that the user will wear the device and exercise the PC muscle. The attractive appearance is also intended to provide pleasure to the partner of the user, with the intention that the partner will actively support the use of the invention. The presence of the anchor member and the sensations of its motion within the female body is also designed to enhance the sexual and sensual feelings of the woman, while the device is worn. Benefits to the strengthening the PC muscle include reduced incidence of incontinence and increased sensation during sexual intercourse.

It is an object of the invention to provide ornamentation to the pelvic region of the human female as an article of erotic body jewelry.

It is a further object of the invention to provide an article of vaginal ornament which is easily and comfortably inserted into the vagina.

It is still a further object of the invention to provide a vaginal ornament which is easily cleaned and maintained to establish suitable hygienic conditions necessary for its continuous wear.

It is another object of this invention to provide gentle erotic and sexual stimulation to the wearer of the article and her partner.

It is yet another object of this invention to provide a means of exercising the vaginal muscles of the human female.

It is a further object of the invention to provide an exercise device for the vaginal muscles which can be readily felt and controlled during the exercise process.

It is another object of this invention to provide visual ornamentation to the pelvic region of the human female, to surmount any psychological objections to such exercise devices and increase usage.

These objects of the invention will be demonstrated by the description of the preferred embodiment of the invention.

DESCRIPTION OF PREFERRED EMBODIMENT

Figure 1:
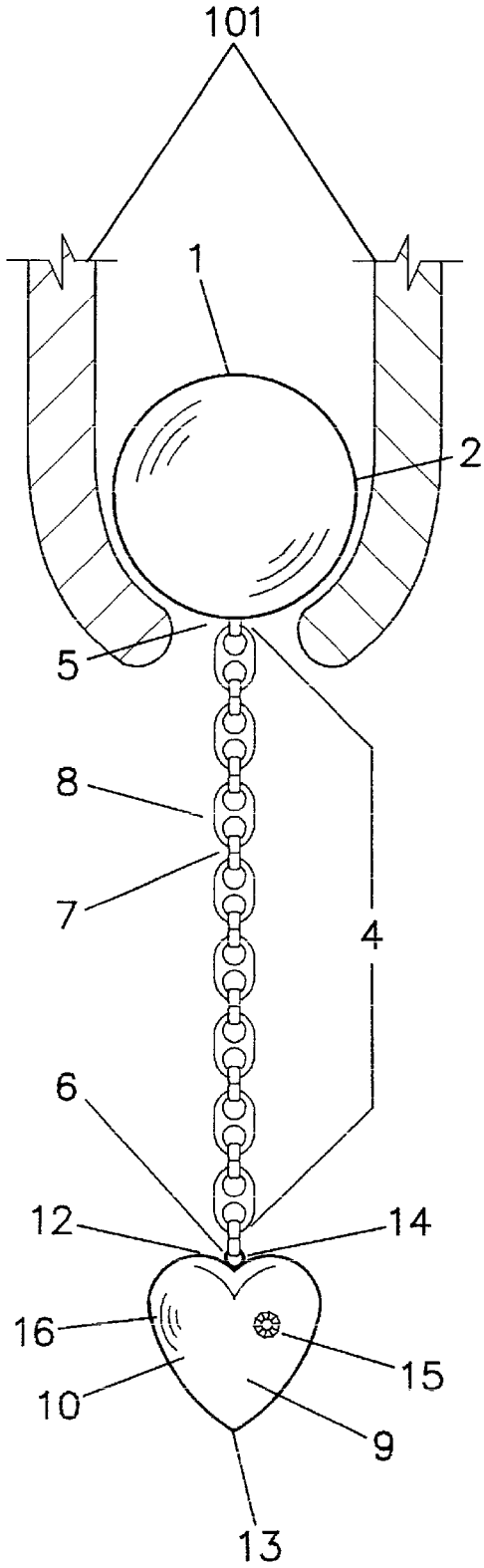
FIG. 1 is a front view of the preferred embodiment of the jewelry.

A detailed description of the figures of the preferred embodiment of the invention follows:

In FIG. 1, the anchor member, 1, is shown with a smooth outer surface, 2. The anchor member, 1, is a rigid, solid extruded acrylic sphere, however, it is not necessary that the sphere be solid. The anchor member of the piece of jewelry which is designed to be inserted in the vagina, 101, of the human female and to provide resistance to the PC muscle action during vaginal exercises. The anchor member need not be spherical in shape, however the anchor member preferably has a smooth, polished exterior, 2. The outer surface, 2, is smooth and nonporous, to ensure ease in maintenance, care and cleaning and optimal wearing comfort for the user. In the preferred embodiment, the anchor member is rigid, producing the intended sensations for the user when positioned within the vagina. However, those skilled in the art will recognize that similar sensations for the user may be achieved with a non-rigid anchor device.

Alternate shapes of the anchor member include, but are not limited to, an egg shape, or oval shape or pear shape or tear drop shape. The anchor member is preferably of a size and shape to be comfortable to the wearer or user of the piece of jewelry and ornamental device. The size of the spherical anchor member in the preferred embodiment is 1.25 inches measured across the diameter of the sphere. The size of the sphere was chosen to fit the average size woman, though the size of the anchor member may be tailored to the particular user for whom the device is intended, if necessary or desired. There is no requirement that the anchor member be a solid mass, it may also be a hollow mass, with a cavity in the interior. The internal cavity within the anchor member may contain a battery assembly or other elements of electronic circuitry in the hollow center of the anchor member. Alternately, the elements of the electronic circuitry may be embedded within a solid anchor member. Circuitry elements may include, but are not limited to, a battery, a microchip or microcontroller, or a timing chip or a small source of light. The only requirement is that all elements be completely contained within the anchor member.

Acrylic was chosen for the material of the anchor member in the preferred embodiment because it has received general FDA approval as a non-toxic material, and because the material is hard and non porous, providing easy cleaning and maintenance of the device. Additionally, the hardness of the acrylic makes the device more resistant to scuffs or scratches incurred during handling and storage of the device. The presence of scratches or flaws in the surface represent regions where bacteria or dirt could possibly become trapped, increasing the difficulty of cleaning the device. Other materials exist with the desired hardness, nonporosity and FDA approval for internal use in the human body and are considered potential candidates for use as the material for the anchor member of the device. For example, to the create a device suitable for the high end or expensive jewelry application, the anchor member may be constructed of a hollow mass of precious metal, or alternately the outer surface of the anchor member could be plated with a precious metal.

Figure 2:
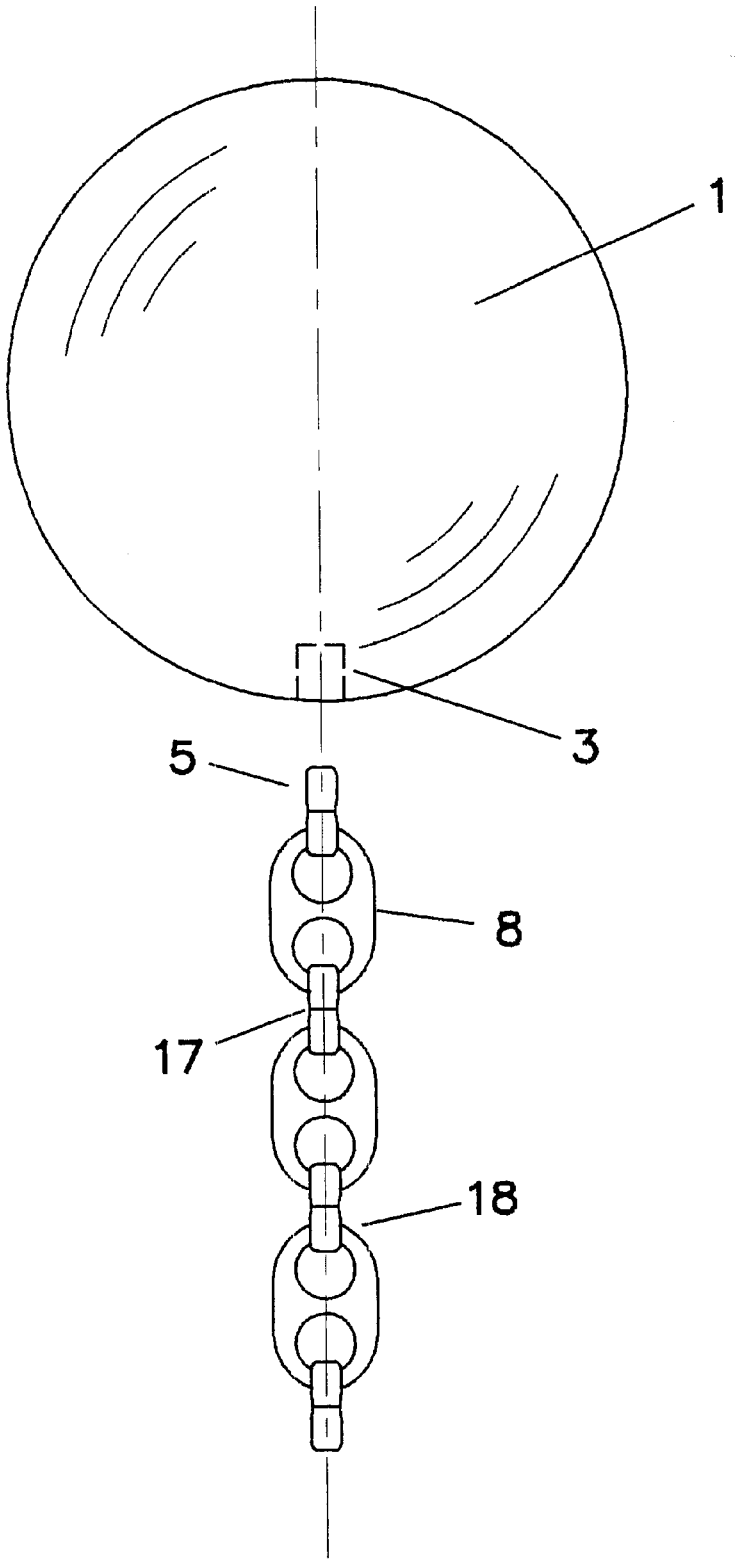
FIG. 2 is a enlarged view of the anchor member and the top end of the connecting chain.

In the preferred embodiment of the invention in FIG. 1, a cylindrical channel, 3, is drilled into the smooth surface, 2 of the spherical anchor member, 1. The channel, 3, is filled with a surgical grade epoxy. FIG. 2 shows an enlarged view of the sphere, 1, including the outline of the channel, 3. A center line, 17, shows that the cylindrical channel, 3, is formed in spherical anchor member, 1, along the center line.

In the preferred embodiment of the invention, the cylindrical channel, 3, is formed in the anchoring member in a suitable manner, such as drilling. Other appropriate processing steps may also be used to form the cylinder. The first end of the connecting means is secured to the anchor member by filing the channel with an appropriate epoxy and inserting the first end of the connecting means into the cylinder, then curing and hardening the epoxy.

The epoxy chosen to bond the connecting means to the anchor of the device is FDA approved for use internally within the human body. Additionally, the epoxy is chosen for ease of use during the manufacture of the device. In the preferred embodiment, the epoxy used is EPO-TEK 301 manufactured by Epoxy Technology of Billerica, Mass. Other types of epoxy may also exist which meet the above mentioned requirements for use in fabricating the device.

In the case where the elements of electronic circuitry are contained within the anchor member, 1, the cylindrical channel, 3, is fabricated such that it extends from the outer surface, 2, through the anchor member to the interior where the circuitry is contained. If the anchor member of the jewelry contains elements of electronic circuitry, then a means to transport the power of the circuit, such as a wire or optical fiber may extend from the circuitry within the anchor member through the cylindrical channel.

In the preferred embodiment of the ornamental device, the connecting means is preferably a gold plated chain, 4, with a first end, 5, and second end, 6. The chain, 4, is constructed of gold plated brass links of two sizes. The chain, 4, is constructed of gold plated brass small chain links, 7, and larger gold plated brass chain links, 8. The first end, 5, of the chain, 4, consists of a small chain link, 7. The first end, 5 of the chain, 4, is inserted into the cylindrical channel, 3, containing the surgical grade epoxy. The epoxy is cured to securely fasten the first end, 5, in the channel, 3, within the anchor member, 1. Those skilled in the art will recognize that other methods of attaching the connecting means to the anchor member are possible, as well.

The first end of the chain is mounted securely into the socket of the sphere with epoxy, the second end, 6, of the chain, 4, is attached securely to the decoration, 9, also with epoxy. In the preferred embodiment, the material of which the chain is constructed is gold plated brass links, however, possible alternate chain materials include 10 or 24 carat gold, silver, platinum, and white gold. The style of the chain, defined by the shape of the links, is chosen to be attractive to the wearer and to feel comfortable against her skin. It will be obvious to those skilled in the art that other styles of chain will also be appropriate as the connecting means.

The style of chain used is chosen for reasons of appearance and comfort, other styles of chains or tethers may be used as the connecting means. Other possible forms of connecting means include, but are not limited to, a string of small beads, a plastic tether, and plastic coated fiber optic strands. The requirements for the connecting means are that it be flexible, strong enough to securely fasten the anchor member to the decoration, and attractive to the user.

Also seen in FIG. 1 is the decoration, 9, which consists of a heart shaped charm, having of a front side, 10, a back side, 11, a top, 12, and a bottom, 13. An eyelet, 14, is shown extending from the top, 12 of the decorations. The eyelet is constructed of a bent piece of wire, which is mounted to the decoration by drilling a hole in the top, 12, then gluing the end of the eyelet into the hole. The hole is drilled such that it is aligned with the bottom, 13, of the decoration. The charm in the preferred embodiment is constructed of injection molded plastic, but those skilled in the art will realize other methods of fabricating the charm are possible. The front side, 10 of the charm is symmetrical, with the exception of a synthetic diamond chipset, 15, embedded into the surface, 16, of the front side, 10. The synthetic chipset is situated on the left half of the front side, 10, of the heart shape decoration, 9. The surface of the heart, 16, is treated to produce a velvet cloth-like feel. The synthetic diamond chipset, 15, is attached to the charm, 9 with epoxy. The second end, 6, of the chain, 4, is linked to the eyelet, 14. The purpose of the decoration or charm is to be aesthetically pleasing to the user. Although the preferred embodiment of the decoration is shown in the figures, it is envisioned that a variety of charms, gems or attractive items could be attached to the second end, 6, of the chain, 4, as decoration. Other methods of attaching the charm to the chain are also possible, as will be obvious to those skilled in the art.

In the preferred embodiment the connecting means of the device extends from the anchor positioned within the vagina to the decoration located outside the body cavity, in the vicinity of the vulva and labia in the pelvic region. The decoration, 9, remains outside the body cavity of the wearer at all times and is visible to the sex partner of the wearer. In the preferred embodiment, the decoration, 9, is a rose colored translucent heart shaped charm constructed of plastic. Embedded in the left side of the heart shaped charm in the preferred embodiment is a synthetic gemstone, 15. A variety of gemstones, synthetic or genuine may be embedded in the heart shaped charm. The type of stone embedded may be chosen for its significance to the wearer of the device, and includes, but is not limited to, synthetic gems, and genuine diamonds, rubies, and sapphires. In the preferred embodiment, the embedded gem is a synthetic diamond chip. Additionally, the charm attached to the end of the chain may be fabricated entirely of a precious gemstone, and may have any shape desired by the wearer. The charm may be fabricated of low cost materials as in the preferred embodiment, or may consist of very expensive and gems or materials. The only limitation on the charm decoration is that it be attractive to the user and comfortable to wear in the pelvic region.

FIG. 2 shows an enlarged view of the anchor member, 1, including the outline of the cylindrical channel, 3. FIG. 2 illustrates that the cylindrical channel, 3, is formed in the anchor member, 1, along the diameter of the sphere. The end, 5, of the connecting chain, 4, is shown aligned with the diameter. The channel, 3, is filled with a surgical grade epoxy resin and the first end, 5, of the connecting chain, 4, is inserted into the channel. The epoxy resin is then cured and hardened Also visible in FIG. 2 is the detail of the two types of links which form the chain, 4.

In the preferred embodiment, the connecting means between the anchor member and the article of decoration is a flexible chain, 4, constructed of two sizes of links. The first type of link is designed to be attractive and stylish in appearance. The second, smaller type of link, 7, is designed to connect the larger links together. In FIG. 2, the small gold plated brass links, 7, are shown to have a front side, 17 and a back side, 18. The front side of the links, 7, are crimped, but continuous and smooth. The backside, 18, of the links, 7, is comprised of the ends of the metal strip which form the link. The chain, 4, is constructed so that all the like faces of the small links, 7, are oriented in the same direction. Each smaller link of the chain comprises a front face and a back face. In the preferred embodiment, the front face of each smaller link is aligned with the face of the decoration containing the gemstone. In the preferred embodiment of the invention, the connecting means is a flexible chain of sufficient length to allow the comfortable placement of the anchor within the body and the visibility of the decoration outside the body cavity.

Figure 3:
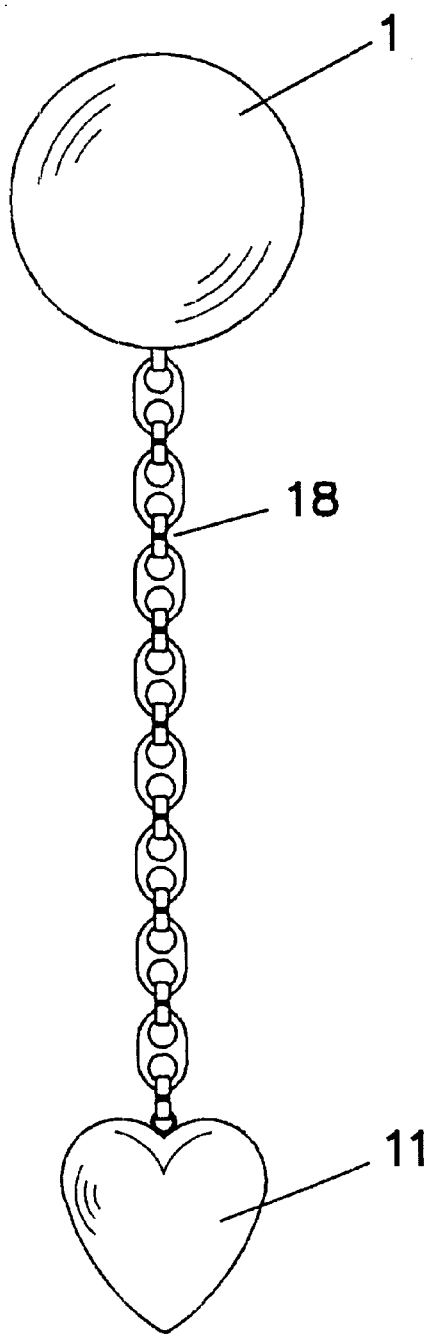
FIG. 3 is a view of the back of the piece of jewelry.

FIG. 3 shows a rear view of the invention. In this view it is seen that the backside, 11 of the heart charm, 9 is symmetric. The rear view of chain, 4, shows that the small links, 7, are oriented so that the back side, 18, is visible from the rear view of the device.

Figure 4:
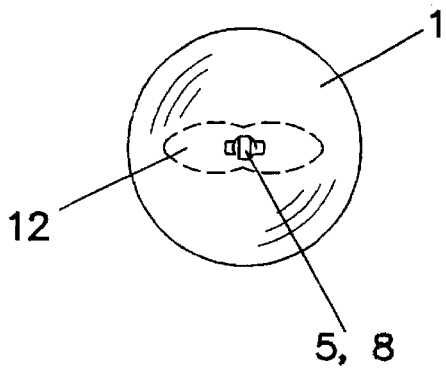
FIG. 4 is a view of the jewelry looking down through the anchor member.

FIG. 4 shows a view looking down on the invention, through the sphere, 1. The outline of the top, 12, of the charm, 9 are visible. Also visible are the first end, 5, of chain 4.

Figure 5:
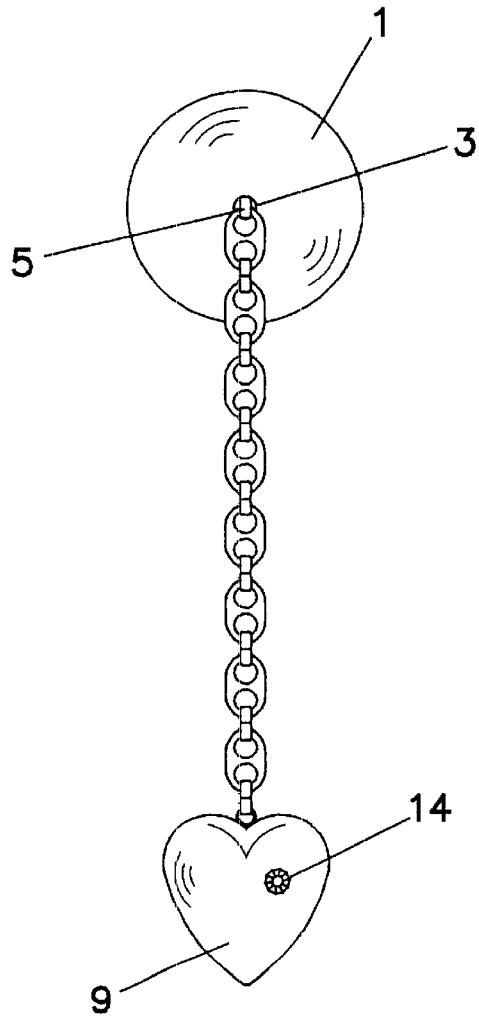
FIG. 5 is a perspective view of the ornament, showing the chain mounted to the anchor member with the front face of the chain links visible and the front face of the decoration.

FIG. 5 shows a perspective view of the preferred embodiment. The channel, 3, is visible in the surface of the anchor member, 1. The first end, 5, of the chain, 4, is shown jutting out of the channel in the anchor member. The chain, 4, is shown hanging extended from the epoxied first end, 5, of chain, 4.

It will be obvious to those skilled in manufacture and use of devices of this type that wide deviations may be made from the shown and described preferred embodiment, without departing from a main theme of invention set forth in claims which follow:

I claim:

1. A method of adorning the vagina and pelvic region in the vicinity of the vulva and labia of a female comprising:

providing a nonporous anchor member having a substantially large enough circumference for retention within the vagina and a decoration and a means of connecting the anchor member to the decoration, whereby the anchor member and decoration are permanently attached to the connecting means;

and inserting the anchor member into the vagina such that the connecting means extends from the anchor member so that the decoration is displayable for adornment about the pelvic region in the vicinity of the vulva and labia.

2. The method of claim 1 wherein the anchor member is a rigid sphere.

3. The method of claim 1 wherein the decoration can be detached from the connecting means.

4. A method for exercising the female pubococcygeus muscle and adorning the vagina and pelvic region in the vicinity of the vulva and labia of the wearer comprising:

providing a nonporous anchor member insertable into the vagina having a substantially large enough circumference for retention within said vagina and a decoration displayable for adornment about said pelvic region and a flexible means of connecting the anchor member to the decoration, the anchor member and decoration are permanently attached to the connecting means;

and inserting the anchor member into the vagina, said anchor member being movable with contractions of said pubococcygeus muscle thereby moving the decoration and providing exercise of said muscle.

5. A piece of vaginal jewelry to adorn and ornament the vagina and pelvic region in the vicinity of the vulva and labia of the female body comprising:

a nonporous spherical member insertable into the vagina having substantially large enough circumference for retention in said vagina;

a chain permanently coupled to the spherical member;

a decoration permanently coupled to the chain;

and said decoration including a gemstone being displayable for adornment about said pelvic region in the vicinity of the vulva and labia.

6. The piece of vaginal jewelry of claim 5 wherein the spherical member is nonporous.

7. The piece of vaginal jewelry of claim 5 wherein the spherical member is acrylic.

8. The piece of vaginal jewelry of claim 5 wherein the chain is a plastic chain.

9. The piece of vaginal jewelry of claim 5 wherein the chain is a metal chain.

10. The piece of vaginal jewelry of claim 5 wherein the decoration is a heart shape.

11. A piece of vaginal jewelry for exercising the female pubococcygeus muscle and for adorning the vagina and pelvic region in the vicinity of the vulva and labia of the wearer, comprising:

a spherical member insertable into the vagina having substantially large enough circumference for retention in said vagina and being capable of being movable with contractions of said pubococcygeus muscle;

a flexible chain extending from the spherical member and being permanently coupled to the spherical member;

and a decorative piece permanently coupled to said chain and displayable about said pelvic region, said decorative piece including a gemstone, and said decorative piece being movable in response to movement of the spherical member thereby being capable of providing exercise of said muscle.

12. The piece of vaginal jewelry of claim 11 wherein the spherical member is nonporous.

13. The piece of vaginal jewelry of claim 11 wherein the spherical member is acrylic.

14. The piece of vaginal jewelry of claim 11 wherein the chain is a plastic chain.

15. The piece of vaginal jewelry of claim 11 wherein the chain is a metal chain.

16. The piece of vaginal jewelry of claim 11 wherein the decorative piece is a heart shape.

* * * * *